US008365751B2

(12) United States Patent
Clampitt

(10) Patent No.: US 8,365,751 B2
(45) Date of Patent: Feb. 5, 2013

(54) MULTIPURPOSE HUNTING BLINDS, METHODS OF MAKING HUNTING BLINDS AND METHODS OF USING HUNTING BLINDS

(75) Inventor: Darwin A. Clampitt, Wilder, ID (US)

(73) Assignee: Intuitive Corporation, Wilder, ID (US)

( * ) Notice: Subject to any disclaimer, the term of this patent is extended or adjusted under 35 U.S.C. 154(b) by 0 days.

(21) Appl. No.: 12/692,434

(22) Filed: Jan. 22, 2010

(65) Prior Publication Data

US 2011/0180119 A1 Jul. 28, 2011

(51) Int. Cl.
*E04H 15/36* (2006.01)

(52) U.S. Cl. ..... 135/124; 135/125; 135/120.1

(58) Field of Classification Search ..... 135/124, 135/125, 901
See application file for complete search history.

(56) References Cited

U.S. PATENT DOCUMENTS

| | | | | | |
|---|---|---|---|---|---|
| 2,159,273 | A | * | 5/1939 | Killinger | 135/125 |
| 3,892,094 | A | * | 7/1975 | Spray | 135/125 |
| 4,075,723 | A | * | 2/1978 | Bareis et al. | 114/361 |
| 4,388,939 | A | | 6/1983 | Barton | |
| 4,404,980 | A | * | 9/1983 | Wade | 135/123 |
| 4,560,196 | A | * | 12/1985 | Carter, Sr. | 296/102 |
| 4,723,371 | A | | 2/1988 | Williams | |
| 4,794,717 | A | * | 1/1989 | Horsmann | 43/1 |
| 4,858,635 | A | | 8/1989 | Eppenbach | |
| D370,046 | S | | 5/1996 | Eppenbach | |
| 5,546,971 | A | * | 8/1996 | Leonhardt | 135/127 |
| 5,595,203 | A | * | 1/1997 | Espinosa | 135/124 |
| 5,842,495 | A | | 12/1998 | Egnew et al. | |
| 5,850,799 | A | * | 12/1998 | Geisel et al. | 114/201 R |
| 5,927,311 | A | * | 7/1999 | Jager | 135/124 |
| 6,016,823 | A | | 1/2000 | Hill | |
| 6,289,909 | B1 | * | 9/2001 | Wood | 135/124 |
| 6,397,774 | B1 | * | 6/2002 | Pranger | 114/263 |
| 6,402,220 | B2 | * | 6/2002 | Allen | 296/77.1 |
| 6,679,009 | B2 | * | 1/2004 | Hotes | 52/86 |
| 7,059,660 | B1 | * | 6/2006 | Juola | 296/163 |
| 7,066,526 | B2 | * | 6/2006 | Weddington et al. | 296/105 |
| 7,111,578 | B2 | * | 9/2006 | Brooks et al. | 114/361 |
| 7,137,660 | B2 | * | 11/2006 | Weddington et al. | 296/105 |
| 7,690,390 | B2 | * | 4/2010 | Hopkins et al. | 135/88.03 |

* cited by examiner

*Primary Examiner* — Noah Chandler Hawk
(74) *Attorney, Agent, or Firm* — TraskBritt

(57) ABSTRACT

Hunting blinds include a frame comprising two rod attachment structures at opposing longitudinal sides and a plurality of support attachment structures extending between and coupled to the two rod attachment structures. A rod is coupled to each of the two rod attachment structures, and a support member rod is coupled to each of the support attachment structures. Methods of using hunting blinds and methods of making hunting blinds are also disclosed.

17 Claims, 4 Drawing Sheets

MULTIPURPOSE HUNTING BLINDS, METHODS OF MAKING HUNTING BLINDS AND METHODS OF USING HUNTING BLINDS

TECHNICAL FIELD

Embodiments of the present disclosure relate generally to hunting blinds. More particularly, various embodiments of the disclosure relate to hunting blinds adaptable for use on a boat or on land.

BACKGROUND

Hunting or observing big game, waterfowl and other wildlife requires that the hunter or observer be concealed and protected as to not disturb the wild animals and yet be relatively safe and comfortable from the elements. Natural blinds, for example, those established in marsh and field areas from natural materials (e.g., reeds, stalks, etc.), when available, are easily broken and/or trampled from use, becoming ineffective cover for concealment after even minor use. Furthermore, such "cover" provides minimal or no shelter from the elements, leaving a wildlife hunter or observer substantially subject to the effects of wind, rain, snow, etc.

Hunters and wildlife observers over the years have built and used their own blinds in which to conceal themselves as well as to keep warm and dry. Many hunters or observers make their own blinds or shelters using heavy, rigid framing elements surrounded by, or overlain with, for example, willow sticks, hay straw or other camouflaging material so as to simulate a naturally occurring environmental element. A variety of hunting blind designs and structures are known, and known to be commercially available. Such blinds or shelters can range from fixed, permanent or semi-permanent field outposts for up to several hunters, to assemblable tent-like structures for a single user.

BRIEF SUMMARY

Various embodiments of the present disclosure comprise hunting blinds that are easily portable and usable in a variety of environments. In one or more embodiments, the hunting blind structure may include a frame comprising two rod attachment structures at opposing longitudinal sides and a plurality of support attachment structures extending between and coupled to the two rod attachment structures. A rod may be coupled to each of the two rod attachment structures, and a support member rod may be coupled to each of the support attachment structures. As the hunting blind structure is positioned for use, the rods are configured in a substantially arcuate shape to shape the frame for supporting a camouflage material secured thereover. In some embodiments, the hunting blind structure may be of a modular configuration, wherein a plurality of blind segments may be longitudinally coupled end-to-end to form a longer hunting blind. In other embodiments, structure used to couple blind segments end-to-end may also be employed to secure camouflage material over an open end of a hunting blind segment.

Other embodiments comprise methods of using hunting blinds. One or more embodiments of such methods may comprise coupling a rod to each of two rod attachment structures extending along opposing longitudinal sides of a frame. A support rod may be coupled to each of at least two support attachment structures. The frame may be positioned so that each of the rods coupled to the two rod attachment structures and the frame comprise a substantially arcuate shape.

Further embodiments of the disclosure comprise methods of making hunting blinds. In one or more embodiments, such methods may comprise forming two rod attachment structures extending at least substantially parallel to each other. Two support attachment structures may be positioned to extend between the two rod attachment structures at opposing longitudinal ends of the two rod attachment structures. Each support attachment structure may be coupled to both of the rod attachment structures.

DETAILED DESCRIPTION

The illustrations presented herein are, in some instances, not actual views of any particular hunting blind or hunting blind assembly but are merely idealized representations employed to describe the present disclosure. Additionally, elements common between figures may retain the same numerical designation.

Figure 1:
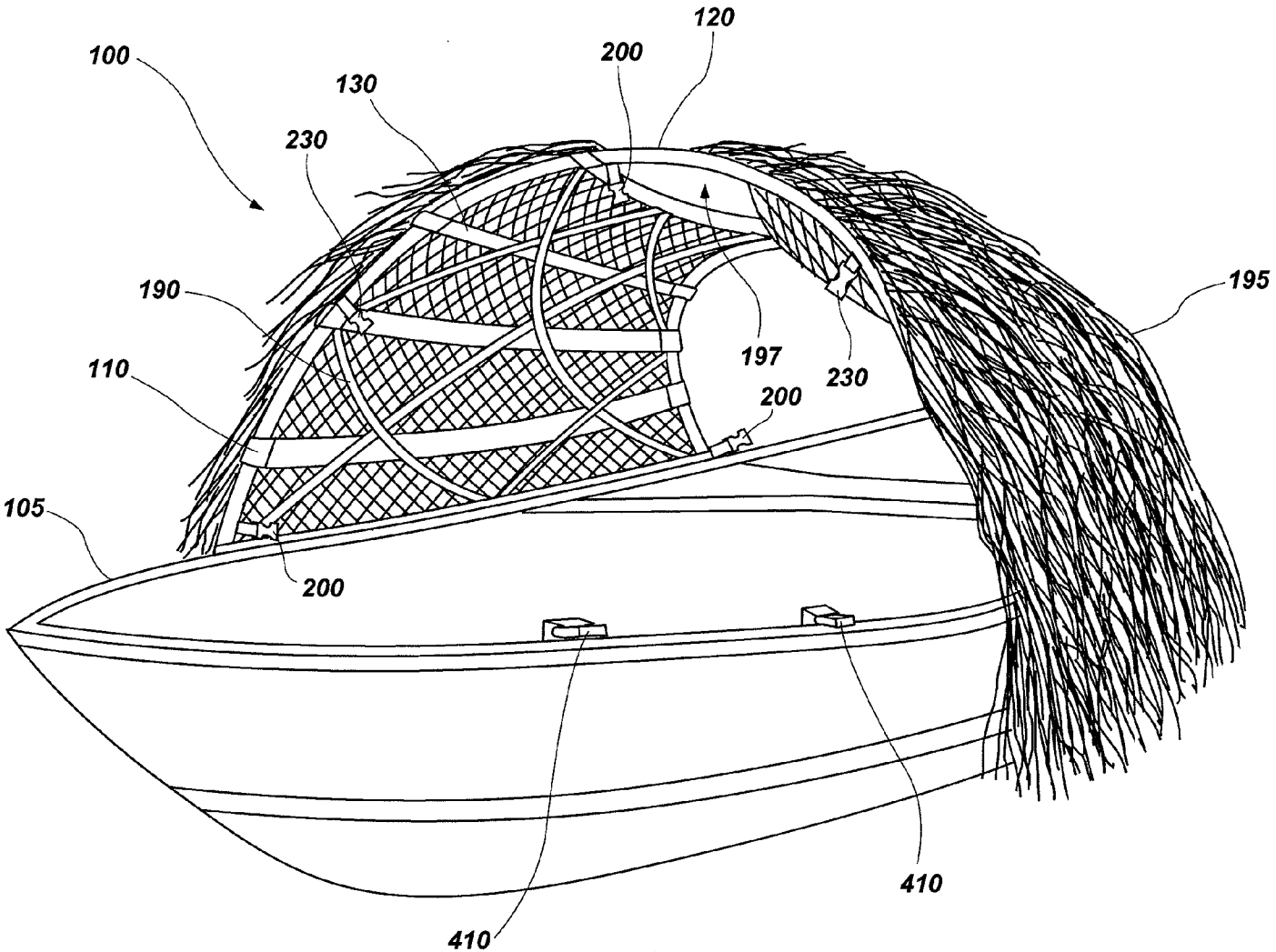
FIG. 1 is an elevation view illustrating a hunting blind according to at least one embodiment positioned for use with a boat.
Figure 2:
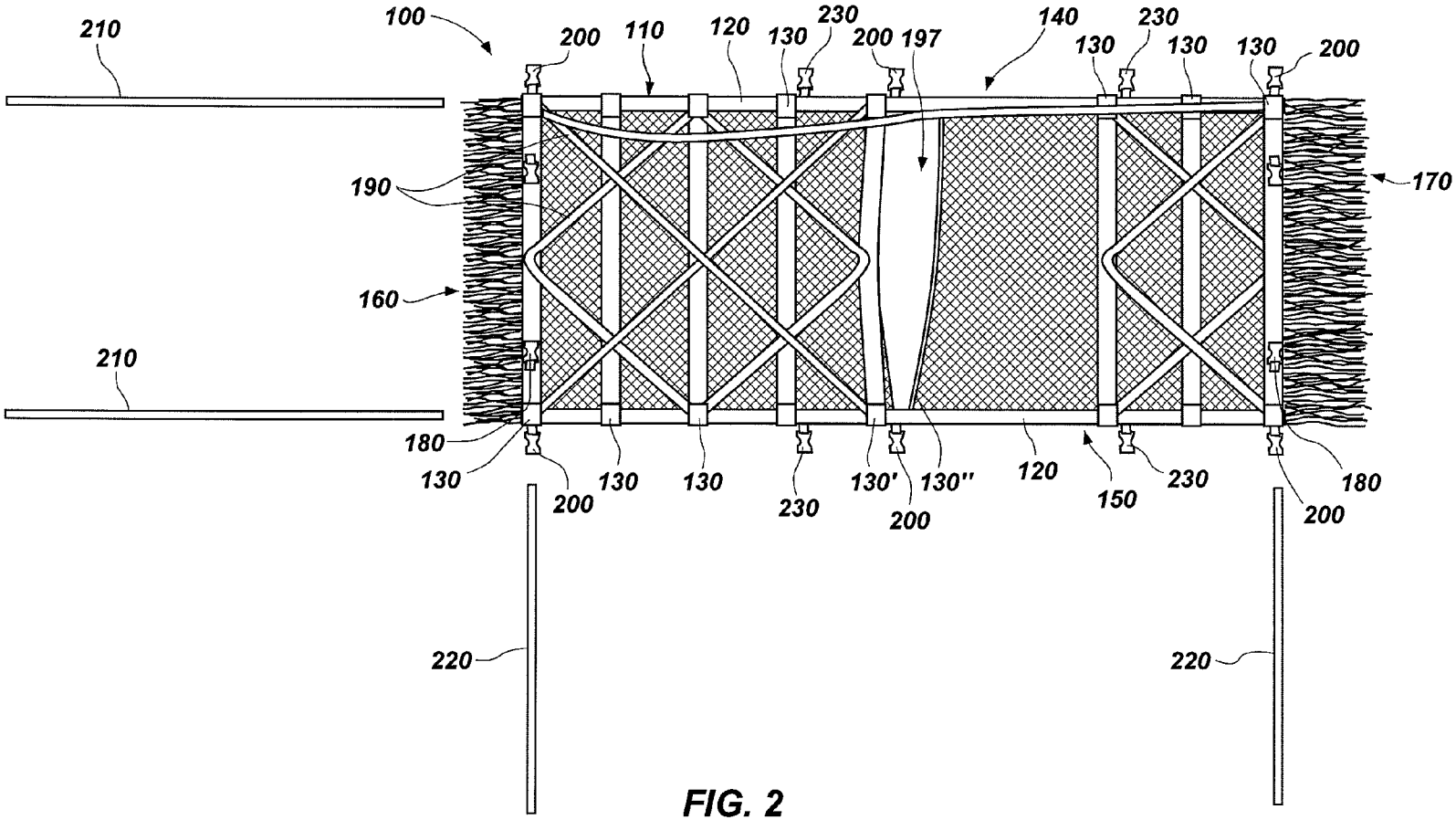
FIG. 2 is a top view of a hunting blind frame according to at least one embodiment.

Various embodiments of the present disclosure comprise multipurpose hunting blinds configured for use on boat or on land. Referring to FIGS. 1 and 2, a multipurpose hunting blind 100 according to at least one embodiment is shown. The hunting blind 100, which may also be characterized as a hunting blind structure or hunting blind segment, comprises a frame 110 including two rod attachment structures 120 and a plurality of support attachment structures 130. The two rod attachment structures 120 are located along opposing longitudinal sides 140, 150 of the frame 110 and are each configured to receive a rod (e.g., rod 210 shown in FIG. 2) to provide structural support in the longitudinal direction of the frame 110. The two rod attachment structures 120 may comprise one or more tubular sleeves extending along at least a portion of each longitudinal side 140, 150. By way of example and not limitation, such tubular sleeves may comprise a nylon material, such as the material sold under the trademark CODURA® by Invista, with global headquarters in Wichita, Kans. In other embodiments, the two rod attachment structures 120 may comprise a plurality of hooks positioned along each of the longitudinal sides 140, 150.

The support attachment structures 130 may comprise one or more tubular sleeves extending between the two rod attachment structures 120. The one or more tubular sleeves of the support attachment structures 130 may comprise the same or a similar nylon material as that employed for tubular sleeves of the two rod attachment structures 120. The frame 110 comprises at least two support attachment structures 130, one at each longitudinal end 160, 170 of the frame 110. Additional support attachment structures 130 may also be provided as shown in FIG. 2 to provide additional support across the length of the frame 110. Furthermore, a plurality of support straps 190 may extend between the longitudinal sides 140, 150 and at least some of the support attachment structures 130. As depicted in FIG. 2, at least some of the support straps 190 may be disposed at oblique angles, for example 45 degree angles, with respect to longitudinal sides 140, 150, and may be criss-crossed at 90 degree angles with respect to one another to provide appropriate tension to ensure structural rigidity.

At least one blind attachment device 180 may be attached to each of the longitudinal ends 160, 170 for attaching the hunting blind 100 to a structure, such as a boat or other structure, as described in more detail below. Furthermore, a plurality of tension coupling devices 200 may be attached to at least one longitudinal side 140, 150. At least one blind coupling device 230 may be attached to each of the longitudinal sides 140, 150 for coupling the hunting blind 100 to one or more longitudinally adjacent additional hunting blinds 100 when a larger (longer) blind structure is desired, or to secure camouflage material over the open ends of the blind. In such an arrangement using multiple hunting blinds 100, each hunting blind 100 comprises a blind segment of an elongated, larger multi-segment hunting blind. By way of example and not limitation, blind attachment device 180, blind coupling device 230 and tension coupling device 200 may each comprise a male or female portion of a quick release buckle.

Referring to FIG. 2, a rod 210 is attached to each of the rod attachment structures 120. For example, the rod 210 may be positioned inside the one or more sleeves in embodiments in which the rod attachment structure 120 comprises one or more sleeves, or the plurality of hooks may be positioned to receive the rod 210 in embodiments in which the rod attachment structure 120 comprises a plurality of hooks. The longitudinal ends of the rod 210 may be coupled to the frame 110 using any suitable attachment means. By way of example and not limitation, the longitudinal ends of the rod 210 may be coupled to the frame 110 using a pocket formed in the frame 110 for receiving the longitudinal end the rod 210, a ring configured to receive the longitudinal end of the rod 210 (similar to the pockets or rings employed in conventional tents for receiving longitudinal ends of tent poles), a pin attached to the frame 110 and configured to be positioned inside an opening in the longitudinal end of the rod 210, or any other suitable means.

In some embodiments, the rods 210 may comprise a flexible rod configured to bend while still maintaining at least some structural strength to the hunting blind 100. For example, the rods 210 may comprise a tent pole that is capable of bending into an arcuate shape. By way of example and not limitation, a suitable tent pole may comprise aluminum, fiberglass, or other known materials. Furthermore, such a tent pole may be comprised of a plurality of sections configured to collapse to a smaller unit when disassembled, similar to a conventional collapsible tent pole. In other embodiments, the rods 210 may comprise a rigid rod comprising an arcuate shape. Such a rigid rod may also comprise a plurality of sections configured to fit together when assembled and to be stored and transported in a collapsed or separated state.

Referring again to FIG. 2, support rods 220 are coupled to the support attachment structures 130. For example, the support rods 220 may be positioned inside the one or more sleeves in embodiments in which the support attachment structures 130 comprise one or more sleeves. The support rods 220 may be retained in such sleeves by enclosing the longitudinal ends of the support attachment structures 130. In at least one embodiment, the support attachment structures 130 may be configured to fasten at the longitudinal ends with a fastener, such as hook-and-loop materials (e.g., VELCRO® materials), ties, snaps, buttons, zippers, etc. The support rods 220 may comprise rigid or semi-rigid elongated rods. For example, the support rods 220 may comprise a rigid material, such as a metal, metal alloy or wood, or a semi-rigid material, such as bamboo or one of a variety of suitable polymers, as well as combinations thereof (i.e., some support rods 220 may comprise a rigid material and some may comprise a semi-rigid material). In at least one embodiment, a wooden support rod 220 may be coupled to the support attachment structures 130 at each longitudinal end 160, 170 of the frame 110, and bamboo support rods 220 may be coupled to the support attachment structures 130 located between the longitudinal ends 160, 170.

As best shown in FIG. 1, the frame 110 is configured to receive camouflage material 195 to conceal a user or an object or both. Various camouflage materials are readily available and known to a person of ordinary skill in the art. One non-limiting example of a suitable camouflage material 195 is sold under the name of Avery REALGRASS™, by Avery Outdoors, Inc. of Memphis, Tenn. and comprises woven mats of slow-dried palm leaves. Alternatively, camouflage materials may be obtained from a hunter's or wildlife observer's surroundings and incorporated into the frame 110 to camouflage and conceal the people or objects.

Figure 3:
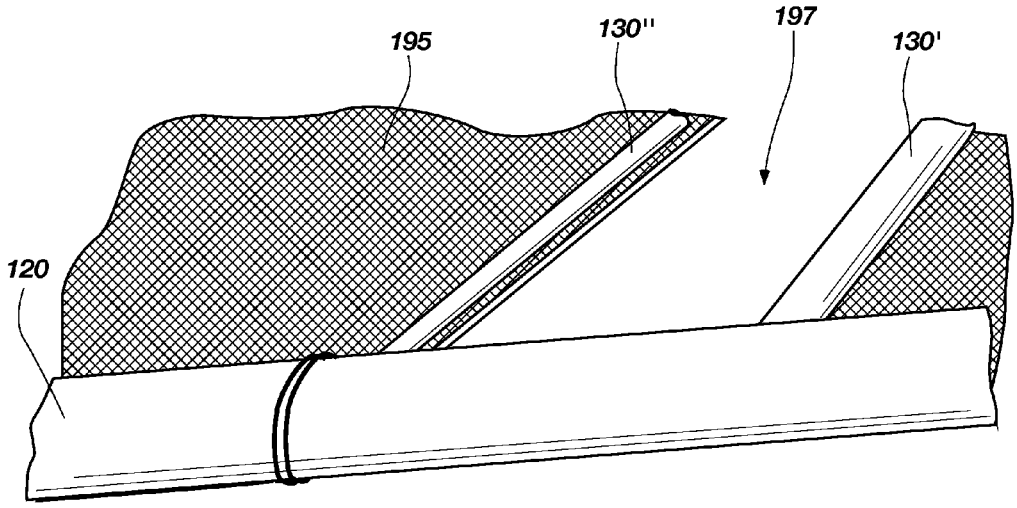
FIG. 3 is a magnified view of a portion of a hunting blind frame illustrating an embodiment of a support attachment structure slideably coupled to a rod attachment structure.

With reference to FIGS. 1 and 2, the camouflage material 195 may be coupled to the frame 110 and configured so that an opening 197 is formed at about a center of the frame 110. The opening 197 may extend between the rod attachment structures 120 and at least substantially perpendicular thereto. In at least one embodiment, two support attachment structures 130' and 130" may be located at least substantially equally spaced from the center of the frame 110. The camouflage material 195 may be coupled to each of the support attachment structures 130' and 130" to define the opening 197. At least one of the support attachment structures 130', 130" may further be movably coupled to the rod attachment structures 120, the rods 210 or both so that the size of the opening 197 may be enlarged or reduced. Referring to FIG. 3, for example, at least one of the support attachment structures 130', 130" may be coupled to the rod attachment structures 120, shown embodied as an elongated sleeve, with a looped attachment structure that wraps around the rod attachment structures 120 and allows at least one of the support attachment structures 130', 130" to slide toward one longitudinal end 160, 170 or the other longitudinal end 160, 170 (FIG. 2).

Figure 4:
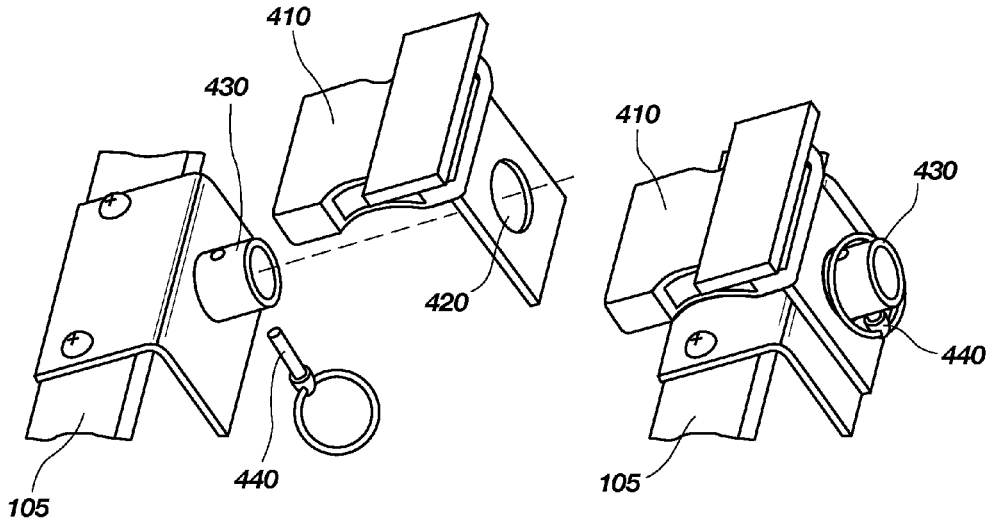
FIG. 4 illustrates an exploded view and an assembled view of an assembly for attaching a structure coupling device to a structure such as a boat.

The hunting blind 100 of the present disclosure may be employed for use in a variety of environments such as, for example, on boat or on land. FIG. 1 illustrates an embodiment of a hunting blind 100 positioned on a boat 105. As shown, the boat 105 may include a plurality of structure attachment devices 410 configured to receive the blind attachment devices 180 (see FIG. 2) of the hunting blind 100. For example, the structure attachment devices 410 may comprise the opposing male or female portion of a quick release buckle configured to receive the portion of the quick release buckle comprising the blind attachment devices 180. The structure attachment devices 410 may be attached to the boat 105 using fasteners, an adhesive, a weld, etc., as well as combinations thereof. Referring to FIG. 4, in at least one embodiment, the structure attachment devices 410 may include an aperture 420 configured to be coupled to a protrusion 430 on the boat 105 and retained by a pin 440.

Figure 5:
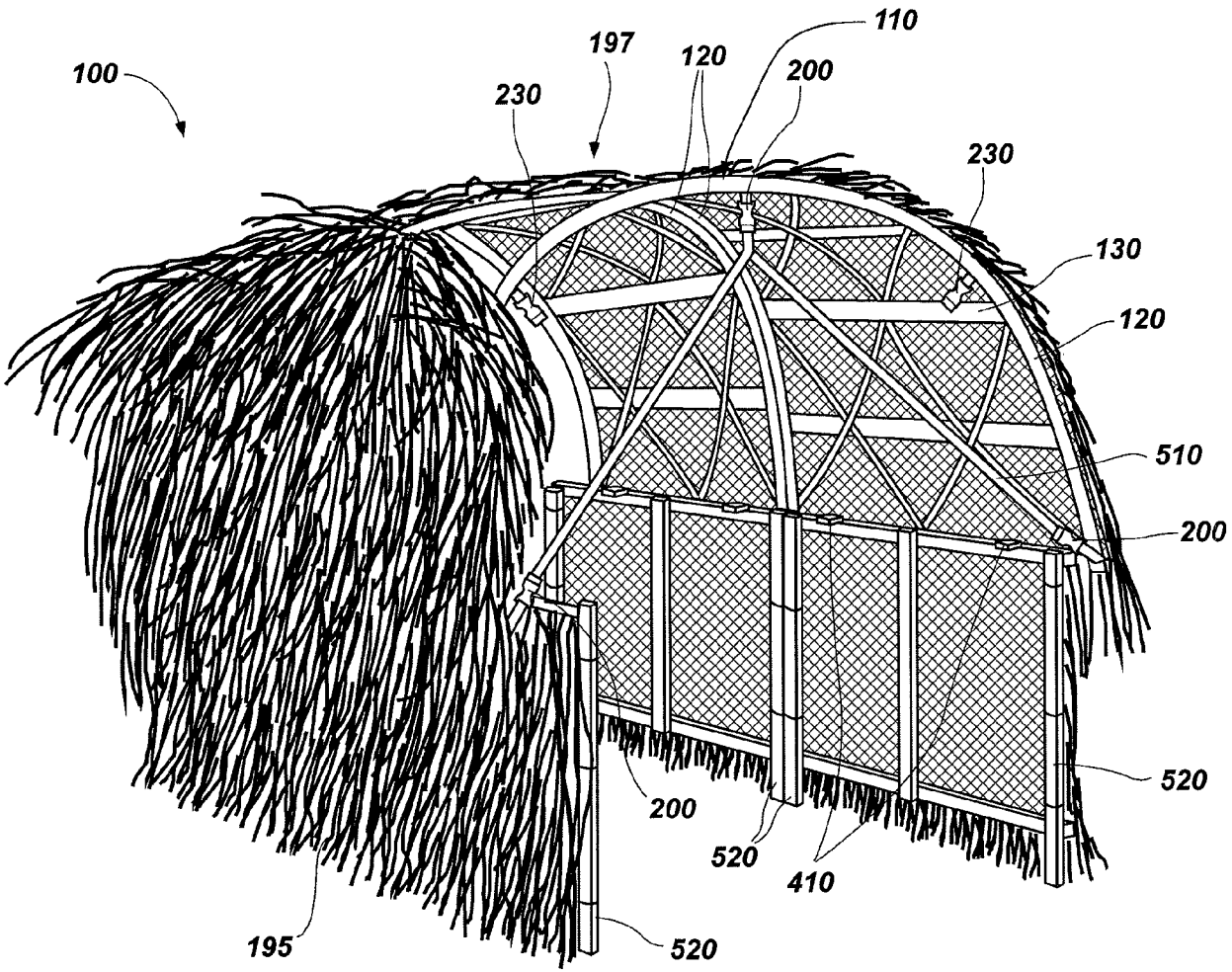
FIG. 5 is an elevation view of an embodiment of a hunting blind positioned for use on land.

FIG. 5 illustrates an embodiment of a hunting blind positioned for use on land. The hunting blind 100 may be positioned over the ground with the opening 197 located at about the top and center of the arcuate-shaped frame 110. In at least some embodiments employing a flexible rod 210 (see FIG. 2), the hunting blind 100 may be retained in the arcuate shape by employing one or more straps 510 coupled to the tension coupling devices 200. The straps 510 may be adjustable to control the radius of the arc formed by the hunting blind 100. In the embodiment depicted in FIG. 5, two hunting blinds 100 are shown placed end-to-end, and are mutually secured using cooperatively engaged blind coupling devices 230 (as depicted in FIGS. 1 and 2) at their respective adjacent ends to form an elongated, larger blind structure.

In at least some embodiments, walls 520 may be employed to increase the height of a hunting blind. The walls 520 may include a structure attachment device 410 for receiving the blind attachment devices 180 (see FIG. 2) of the hunting blind 100. For example, the structure attachment device 410 may comprise an opposing male or female portion of a quick release buckle. The walls 520 may comprise a rigid frame structure and may include extensions (not shown) configured to pierce the ground to anchor the walls 520 to the ground, or may be attachable to stakes or other anchoring systems to provide support to the walls 520. The walls 520 may also be configured to comprise a plurality of sections that may be coupled to one another with one or more alignment pins configured to extend partially into two adjacent wall sections in the longitudinal direction. Each section of the walls 520 may be welded or otherwise fixedly configured in some embodiments, or each wall 520 may be coupled in such a manner as to allow the walls 520 to be disassembled for improved portability. The walls 520 are configured to receive camouflage material that matches the camouflage material 195 coupled to the frame 110. Furthermore, in some embodiments, camouflage material 195 may be disposed at the two open ends of adjacent, mutually secured hunting blinds 100 shown in FIG. 5 and secured to the open ends using blind coupling devices 230 as depicted in FIGS. 1 and 2 to at least substantially enclose the entire structure.

In use, the hunting blind 100 may be assembled by coupling a rod 210 to each of the rod attachment structures 120 extending along each longitudinal side 140, 150, as shown in FIG. 2. Furthermore, a support rod 220 is coupled to each of the support attachment structures 130. With the rods 210 coupled to the rod attachment structures 120 and the support rods 220 coupled to the support attachment structures 130, the frame 110 may be positioned so that each of the rods 210 comprises a substantially arcuate shape, as illustrated in FIGS. 1 and 5. With the rods 210 comprising a substantially arcuate shape, the frame 110 also comprises at least substantially the same arcuate shape with openings adjacent to each longitudinal side 140, 150. As discussed above, a camouflage material 195 may be coupled to the frame 110 to provide concealment for people and objects below the arcuate-shaped frame 110.

The frame 110 may be secured to a supporting structure (e.g., boat 105, walls 520, etc.). In such embodiments, one longitudinal end 160, 170 of the frame 110 is secured to one side of the supporting structure by coupling the blind attachment devices 180 of the frame 110 to the supporting structure attachment devices 410 of the supporting structure. The rods 210 may be configured to allow the frame 110 to bend into the arcuate shape when the two longitudinal ends 160, 170 are secured to the supporting structure, or the rods 210 may be preformed to comprise the arcuate shape, resulting in an arcuate shaped hunting blind 100 with the opening 197 positioned at about the top of the arc.

In some embodiments, one or more straps 510 may be coupled to the tension coupling devices 200 of the frame 110, as shown in FIG. 5. The length of the straps 510 may be adjusted to configure the radius of the frame 110 according to the particular application. In some embodiments, the frame 110 may be secured to walls 520 to give the hunting blind 100 additional height. The walls 520 may need to be assembled or at least partially assembled, according to various embodiments, and the wall 520 may be anchored into the ground. The rods 210 (see FIG. 2) may be configured to allow the frame 110 to bend into the arcuate shape when the two longitudinal ends 160, 170 (FIG. 2) are attached to the walls 520, or the rods 210 may be preformed to comprise an arcuate shape, resulting in the arcuate shaped hunting blind 100 with the opening 197 positioned at about the top of the arc, as shown in FIG. 5. When using at least some embodiments, the opening 197 may be increased and decreased by moving at least one support attachment structure 130 that is slideably coupled to the two rod attachment structures 120.

Further embodiments of the present disclosure comprise methods of making a hunting blind 100. Referring generally to FIGS. 1-5, such methods may include forming two rod attachment structures 120 extending substantially parallel to each other to form the opposing longitudinal sides 140, 150 of the frame 110. At least two support attachment structures 130 may be disposed extending between the two rod attachment structures 120. The at least two support attachment structures 130 may be disposed at opposing longitudinal ends of the two rod attachment structures 120 and coupled to each of the rod attachment structures 120. Additional support attachment structures 130 may be included between the two rod attachment structures 120 to provide additional support across the length of the frame 110.

The two rod attachment structures 120 may comprise at least one tubular sleeve extending along each of the opposing longitudinal sides 140, 150. In other embodiments, the two rod attachment structures 120 may comprise a plurality of hooks along each of the longitudinal sides 140, 150. In at least some embodiments, a plurality of support straps 190 may be positioned between the longitudinal sides 140, 150 and at least some of the support attachment structures 130. Furthermore, rods 210 may be attached to each of the rod attachment structures 120 and support rods 220 may be coupled to the support attachment structures 130, as shown in FIG. 2. Additional elements may also be coupled to the frame 110 as described above with reference to FIGS. 1 and 2, including a plurality of blind attachment devices 180, blind coupling devices 230, camouflage material 195, and tension coupling devices 200.

While certain embodiments have been described and shown in the accompanying drawings, such embodiments are merely illustrative and not restrictive of the scope of the disclosure, and this disclosure is not limited to the specific constructions and arrangements shown and described, since various other additions and modifications to, and deletions from, the described embodiments will be apparent to one of ordinary skill in the art. Thus, the scope of the disclosure is only limited by the literal language, and legal equivalents, of the claims that follow.

What is claimed is:

1. A hunting blind, comprising:

at least one hunting blind structure, including:

a frame comprising:

two rod attachment structures at opposing longitudinal sides and support attachment structures extending between and coupled to the two rod attachment structures;

a rod coupled to each of the two rod attachment structures;

a support member rod coupled to each of the support attachment structures; and a plurality of criss-crossed support straps oriented at oblique angles with respect to the opposing longitudinal sides of the frame and the plurality of support attachment structures, at least some support straps extending between the opposing longitudinal sides, at least some support straps extending between the opposing longitudinal sides and at least some of the support attachment structures, and at least some support straps mutually criss-crossing at one or more support attachment structures removed from the opposing longitudinal sides.

2. The hunting blind of claim 1, wherein at least one of the rods and the support member rods comprise flexible rods.

3. The hunting blind of claim 1, further comprising at least one blind attachment device attached to each longitudinal end of the frame and configured for coupling the frame to a structure.

4. The hunting blind of claim 3, wherein the at least one blind attachment device is configured to attach the frame to a structure comprising at least one of a boat and a wall.

5. The hunting blind of claim 4, further comprising a wall extending along, beneath and attached to the frame between opposing longitudinal sides of the blind.

6. The hunting blind of claim 1, further comprising a camouflage material attached to the frame.

7. The hunting blind of claim 6, further comprising an opening in the camouflage material extending between the two rod attachment structures and at least substantially perpendicular thereto, and bounded by adjacent support attachment structures.

8. The hunting blind of claim 7, wherein at least one support attachment structure of the adjacent support attachment structures is slideably coupled to the two rod attachment structures for adjustment of a size of the opening in the camouflage material through longitudinal movement of the at least one support attachment structure.

9. The hunting blind of claim 6, wherein the camouflage material comprises a natural, non-fabric material.

10. The hunting blind of claim 9, wherein the natural, non-fabric material comprises leaves.

11. The hunting blind of claim 1, wherein the rods coupled to each of the two rod attachment structures comprise a substantially arcuate shape and define an end of the at least one hunting blind structure.

12. The hunting blind of claim 11, wherein the at least one hunting blind structure comprises a plurality of longitudinally coupled hunting blind structures.

13. The hunting blind of claim 11, further comprising a camouflage material coupled over an open end of the at least one hunting blind structure.

14. The hunting blind of claim 1, wherein the oblique angles comprise 45 degree angles to the opposing longitudinal sides.

15. The hunting blind of claim 1, wherein at least one support strap of the plurality of support straps is criss-crossed with respect to at least another support strap of the plurality substantially at a 90 degree angle thereto.

16. The hunting blind of claim 1, further comprising:

a tension coupling device proximate each opposing end of a rod attachment structure of at least one longitudinal side and a tension coupling device secured proximate a midpoint of the rod attachment structure; and at least one strap coupled to and extending from the tension coupling device at one end of the rod attachment structure of the at least one longitudinal side to, and coupled to, the tension coupling device proximate the midpoint of the rod attachment structure and further extending to, and coupled to, a tension coupling device proximate the opposing end of the rod attachment structure of the at least one longitudinal side.

17. The hunting blind of claim 16, wherein the tension coupling devices and straps respectively coupled thereto are located at both longitudinal sides of the frame.

* * * * *